US008695385B2

(12) United States Patent
Meekma et al.

(10) Patent No.: US 8,695,385 B2
(45) Date of Patent: Apr. 15, 2014

(54) SAFE WITH DUAL LOCKING MECHANISM

(75) Inventors: Glenn P. Meekma, Menomonee Falls, WI (US); Dean D. Hacker, Oak Creek, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 12/917,613

(22) Filed: Nov. 2, 2010

(65) Prior Publication Data

US 2011/0100074 A1 May 5, 2011

Related U.S. Application Data

(60) Provisional application No. 61/257,253, filed on Nov. 2, 2009.

(51) Int. Cl.
*B65D 55/14* (2006.01)
*E05B 37/00* (2006.01)

(52) U.S. Cl.
USPC ..... 70/63; 70/DIG. 63; 70/162; 292/254

(58) Field of Classification Search
USPC ..... 70/63, 159–162, 297–300, 333 A, 70/423–428, 455, DIG. 63, 169, 173; 292/144, 183, 252, 254
See application file for complete search history.

(56) References Cited

U.S. PATENT DOCUMENTS 120,419 A * 10/1871 Crossman ..... 292/227
145,835 A * 12/1873 Bissell ..... 292/254
195,117 A * 9/1877 Frankel ..... 292/83
229,995 A * 7/1880 Freeman ..... 292/124
290,729 A * 12/1883 Ball ..... 292/127
311,134 A * 1/1885 McCaffrey ..... 292/254
946,570 A * 1/1910 Teetar ..... 292/254
1,133,254 A * 3/1915 Backus ..... 292/127
1,185,422 A * 5/1916 Mammelli ..... 292/227
D59,734 S 11/1921 Fisher (Continued)

FOREIGN PATENT DOCUMENTS

JP 5-71255 3/1993
JP 2006-327332 12/2006

(Continued)

OTHER PUBLICATIONS

International Search Report and Written Opinion from International Application No. PCT/US2010/055039, mailed Jan. 11, 2011.

(Continued)

*Primary Examiner* — Peter M Cuomo
*Assistant Examiner* — Ifeolu Adeboyejo
(74) *Attorney, Agent, or Firm* — Calfee, Halter & Griswold LLP

(57) ABSTRACT

A safe for providing security and storage of personal items. The safe includes a housing, a door, a user operable locking mechanism and a user operable release mechanism. The door can be opened only upon both proper manipulation of the user operable locking mechanism and proper manipulation of the user operable release mechanism. The user operable release mechanism is disposed to reduce the risk of theft of the contents of the safe by unauthorized attempts to manipulate the release mechanism. The safe may include a mounting arrangement for mounting the housing to a structure to reduce the risk of theft of the safe.

12 Claims, 7 Drawing Sheets

(56) References Cited

U.S. PATENT DOCUMENTS

| | | | | |
|---|---|---|---|---|
| 1,634,884 | A | 7/1927 | Peer | |
| 1,955,809 | A | 4/1934 | Hobbs | |
| 2,108,965 | A * | 2/1938 | Gray | 292/75 |
| 2,625,293 | A * | 1/1953 | Hollerith | 220/326 |
| D175,369 | S | 8/1955 | Sciacero | |
| 2,755,748 | A | 7/1956 | Parker, Jr. | |
| D181,025 | S | 9/1957 | Sederquist et al. | |
| D183,094 | S | 6/1958 | Heath | |
| 3,026,704 | A | 3/1962 | Baker | |
| 3,084,532 | A | 4/1963 | Williams | |
| 3,146,739 | A | 9/1964 | Furman | |
| 3,742,741 | A | 7/1973 | Cahan | |
| 3,788,007 | A * | 1/1974 | Bailey | 49/449 |
| D231,895 | S | 6/1974 | Stolarz | |
| 3,934,434 | A | 1/1976 | Law | |
| 4,109,950 | A * | 8/1978 | Amdal | 292/254 |
| 4,252,363 | A * | 2/1981 | Rodrigue | 296/100.12 |
| D271,350 | S | 11/1983 | Robbins | |
| D273,053 | S | 3/1984 | Hamborg | |
| D278,689 | S | 5/1985 | Jupe | |
| D279,324 | S | 6/1985 | Tanaka | |
| 4,641,505 | A | 2/1987 | Maurice | |
| 4,651,544 | A | 3/1987 | Hungerford | |
| 4,667,492 | A * | 5/1987 | Tomatsu et al. | 70/261 |
| D298,679 | S | 11/1988 | Casini et al. | |
| 4,838,052 | A * | 6/1989 | Williams et al. | 70/63 |
| 4,872,326 | A | 10/1989 | Aurness et al. | |
| D309,054 | S | 7/1990 | Knox | |
| D310,211 | S | 8/1990 | Tanbe | |
| 4,951,577 | A | 8/1990 | Bentley | |
| 5,065,156 | A | 11/1991 | Bernier | |
| D350,002 | S | 8/1994 | Viola | |
| D351,499 | S | 10/1994 | Gay et al. | |
| 5,460,020 | A * | 10/1995 | Hungerford | 70/63 |
| D365,430 | S | 12/1995 | Riboli | |
| D380,793 | S | 7/1997 | Conwell | |
| 5,682,910 | A * | 11/1997 | Kizawa et al. | 132/293 |
| 5,737,947 | A | 4/1998 | Ling | |
| 5,738,020 | A | 4/1998 | Correia | |
| 5,758,522 | A | 6/1998 | York | |
| D407,184 | S | 3/1999 | Endelson | |
| 5,927,114 | A | 7/1999 | Berry | |
| 6,082,155 | A * | 7/2000 | Su | 70/22 |
| D432,755 | S | 10/2000 | Perkitny et al. | |
| 6,318,134 | B1 * | 11/2001 | Mossberg et al. | 70/63 |
| 6,381,997 | B1 * | 5/2002 | Chen | 70/28 |
| D462,517 | S | 9/2002 | Knox et al. | |
| D484,776 | S | 1/2004 | Ruan | |
| 6,792,778 | B1 * | 9/2004 | Chen | 70/21 |
| 6,813,912 | B1 * | 11/2004 | Ng et al. | 70/21 |
| 6,834,519 | B1 | 12/2004 | Yang | |
| 7,057,660 | B1 | 6/2006 | Okuda | |
| 7,131,299 | B1 * | 11/2006 | Huang | 70/21 |
| 7,152,439 | B1 * | 12/2006 | Chang | 70/30 |
| D534,965 | S | 1/2007 | Chung | |
| D539,540 | S | 4/2007 | Perlman et al. | |
| D549,552 | S * | 8/2007 | Huang | D8/333 |
| 7,251,967 | B2 * | 8/2007 | Yang | 70/63 |
| 7,299,667 | B1 | 11/2007 | Miresmaili | |
| D560,875 | S | 1/2008 | Decarlo et al. | |
| D569,609 | S | 5/2008 | Hacker | |
| 7,426,841 | B2 | 9/2008 | Yang | |
| D579,174 | S | 10/2008 | Decarlo et al. | |
| 7,434,426 | B2 | 10/2008 | Loughlin et al. | |
| D590,695 | S | 4/2009 | Wu | |
| 7,516,631 | B2 | 4/2009 | Hacker et al. | |
| D592,934 | S | 5/2009 | Yang | |
| 7,540,175 | B2 * | 6/2009 | Kalous et al. | 70/63 |
| D614,044 | S | 4/2010 | Mouquet | |
| D623,824 | S | 9/2010 | Pendleton | |
| D630,260 | S | 1/2011 | Cole et al. | |
| 7,891,220 | B2 | 2/2011 | Yen et al. | |
| D634,915 | S | 3/2011 | Nave et al. | |
| D635,324 | S | 3/2011 | Plato | |
| D635,325 | S | 3/2011 | Plato | |
| 7,913,526 | B2 | 3/2011 | Loughlin et al. | |
| D638,684 | S | 5/2011 | Stevens | |
| 7,934,406 | B2 | 5/2011 | Loughlin et al. | |
| 7,946,141 | B2 | 5/2011 | Ng et al. | |
| D641,535 | S | 7/2011 | Kan | |
| D642,893 | S | 8/2011 | Yang | |
| 8,020,415 | B2 * | 9/2011 | Corbin et al. | 70/63 |
| 2003/0141959 | A1 | 7/2003 | Keogh et al. | |
| 2004/0226325 | A1 * | 11/2004 | Ling | 70/63 |
| 2005/0223758 | A1 | 10/2005 | Yu | |
| 2005/0229655 | A1 | 10/2005 | Yu | |
| 2006/0065024 | A1 | 3/2006 | Gutierrez et al. | |
| 2006/0137949 | A1 | 6/2006 | Levinson et al. | |
| 2006/0213237 | A1 * | 9/2006 | Yang | 70/63 |
| 2006/0267364 | A1 | 11/2006 | Katagiri | |
| 2007/0175248 | A1 * | 8/2007 | Wu et al. | 70/58 |
| 2007/0180873 | A1 | 8/2007 | Yen et al. | |
| 2008/0083251 | A1 * | 4/2008 | Lai et al. | 70/21 |
| 2008/0011554 | A1 | 5/2008 | Yang | |
| 2008/0098939 | A1 | 5/2008 | Kalous et al. | |
| 2008/0223088 | A1 * | 9/2008 | Yang | 70/21 |
| 2009/0183537 | A1 * | 7/2009 | Yen et al. | 70/63 |
| 2010/0242553 | A1 * | 9/2010 | Yang | 70/160 |
| 2011/0210136 | A1 * | 9/2011 | Wang | 220/831 |

FOREIGN PATENT DOCUMENTS

| | | | |
|---|---|---|---|
| JP | 2011080253 A | * | 4/2011 |
| TW | 341083 U | * | 9/2008 |
| WO | 2008/094137 | | 8/2008 |

OTHER PUBLICATIONS

International Search Report and Written Opinion from International Application No. PCT/US2007/04968, mailed Aug. 27, 2008.

Notice of Reasons for Rejection from Japanese Patent Application No. 2012,537184, dated Aug. 26, 2013.

* cited by examiner

SAFE WITH DUAL LOCKING MECHANISM

CROSS-REFERENCE TO RELATED APPLICATION

This application claims the benefit of U.S. Provisional Patent Application Ser. No. 61/257,253, entitled SAFE WITH DUAL LOCKING MECHANISM and filed Nov. 2, 2009, the entire disclosure of which is incorporated herein by reference, to the extent that it is not conflicting with the present application.

BACKGROUND

Safes are used in many indoor and outdoor environments to restrict access to various items by providing an enclosure with a door or other such access port. A safe typically includes a locking mechanism, such as, for example, a combination lock, padlock, or key operated latch, to limit access to the contents of the safe to one or more authorized users. Some applications may require secure storage of a smaller item, such as for example, a key. One example of such an application involves a key used to gain access to a location or structure to which many individuals may from time to time require access, such as for example, a storage locker, office building, or a portion of a vehicle or structure attached to a vehicle, such as for example, a trunk, trailer, or car top/cargo carrier.

Where multiple users require access to such a key, it may be desirable to store the key on or near the location or structure with which the key is used. While keeping the key in an unsecured location would risk loss or theft of the key, thereby compromising the lock with which the key is associated, conventional safes and other locking enclosures may be impractical or ineffective for securely storing a key. A relatively large locked enclosure, such as a more traditional safe, may be aesthetically undesirable, inconvenient, or obstructive, and may not be easily or inexpensively mountable, for example, to a wall or door. A smaller portable safe, if kept in a location where any potential authorized user may access it, may be at risk of loss or theft of the entire safe, along with its contents.

SUMMARY OF THE INVENTION

In an illustrated embodiment of the invention, a safe has dual security features to prohibit unauthorized access to contents stored within the safe. The safe may include a user locking interface, such as a combination lock, and a user release mechanism, such as one or more side interface buttons. The buttons may be designed to fail if tampered with prior to proper manipulation of the locking interface. The safe may be secured to a location by several arrangements, such as by example, a shackle secured to a wall mounted hasp, a shackle positioned around a door handle, or a housing directly mounted to a wall. The mounting arrangement reduces the risk of theft of the safe.

BRIEF DESCRIPTION OF THE DRAWINGS

Features and advantages of the invention will become apparent from the following detailed description made with reference to the accompanying drawings.

DETAILED DESCRIPTION OF THE INVENTION

Figure 1:
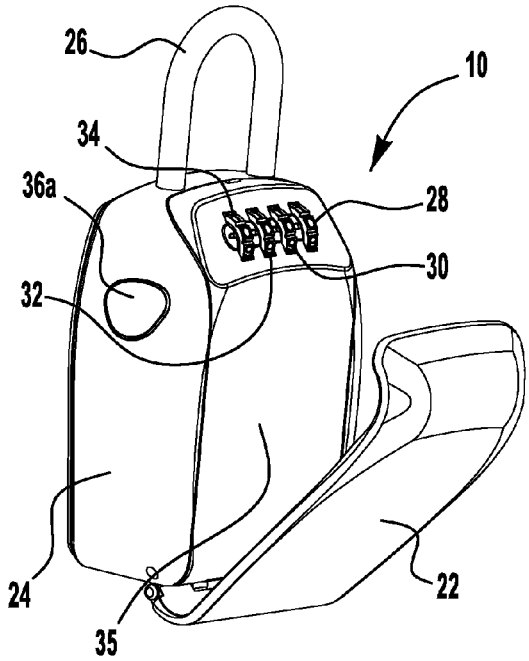
FIG. 1 is a front perspective view of a safe, showing a cover partially opened and a set of combination dials exposed.

This Detailed Description of the Invention merely describes embodiments of the invention and is not intended to limit the scope of the claims in any way. Indeed, the invention as claimed is broader than and unlimited by the preferred embodiments, and the terms used in the claims have their full ordinary meaning.

According to an inventive aspect of the present application, a safe may be provided that includes at least two mechanisms to reduce the risk of theft of the contents of the safe. Each mechanisms may be either directly or indirectly user operable. The mechanisms may be a locking mechanism and a releasing mechanism each requiring proper manipulation to provide user access to the contents of the safe. The locking mechanism may include a locking member, such as a cage blocker, and the releasing mechanism may include a releasing member, such as a latch. The safe includes an inner cavity that may be enclosed by a door.

An exemplary safe includes a door movable from a locked position to an unlocked position. When the locking mechanism has been properly manipulated and the releasing mechanism has been properly manipulated, the door is moved to an unlocked position and can be opened. The locking mechanism includes a plurality of combination dials that may be moved to a proper orientation to move a lock member to an unlocked position. In such an unlocked position, a user may properly manipulate the release mechanism.

An exemplary safe includes a housing, a door, and a first and second locking mechanism for moving the door between a locked condition and an unlocked condition, and a door opening mechanism for moving a door in an unlocked condition from a closed condition to an open condition. The housing defines an internal compartment for storage of valuable or important items, such as for example, a key. In one embodiment, the locking mechanism is a combination lock utilizing single or multiple combination dials. The user interface is configured such that proper manipulation of the first locking mechanism allows a user to manipulate the second locking mechanism, e.g., access buttons, to open the lockable door to gain access to the compartment. As such, the safe has dual locking system characteristics.

The safe may be mountable to a structure, such as for example, a building or a vehicle, to reduce the risk of theft of the safe. In one embodiment, the safe includes a shackle that can be mounted to a structure, such as for example, a hasp, a hook, a door handle or door knob. The shackle may have a short leg and a long leg, in which the long leg is securely engaged when at least one of the locking mechanisms is in the locked condition. The safe may be shackleless and mountable by other mounting arrangements in the safe.

Conventional personal safes or lock boxes have large opening buttons or protruding knobs. These buttons are vulnerable to attack. The safe of the present invention allows for higher security than conventional lock box safes. Its structure makes it very difficult for the safe to be rapped open by unauthorized physical manipulation of one or more buttons. The safe of the present invention incorporates at least one integral button that permits the opening of the safe by proper manipulation. The side buttons are flush with the outer surface of the outer housing. Because these buttons do not stick out from the housing outer walls, the buttons are less susceptible to attack. To be discussed in greater detail, the pinching motion of one of more buttons works in operation with the door lock mechanism to create an inventive dual locking structure.

Referring now to the drawings, FIG. 1 is a front perspective view of a safe 10 of an illustrated embodiment. The safe includes a cover 22 which rotates about hinges on the bottom of a housing 24. The cover 22 is shown in a partially open position, and is provided to protect a user operable locking interface when the safe 10 is not in use. As shown, the user operable locking interface is a plurality of combination dials. The dials interact with a locking mechanism disposed within the housing. The housing 24 defines an internal compartment, or cavity (not shown) for storage of items, such as for example, a key.

Figure 3:
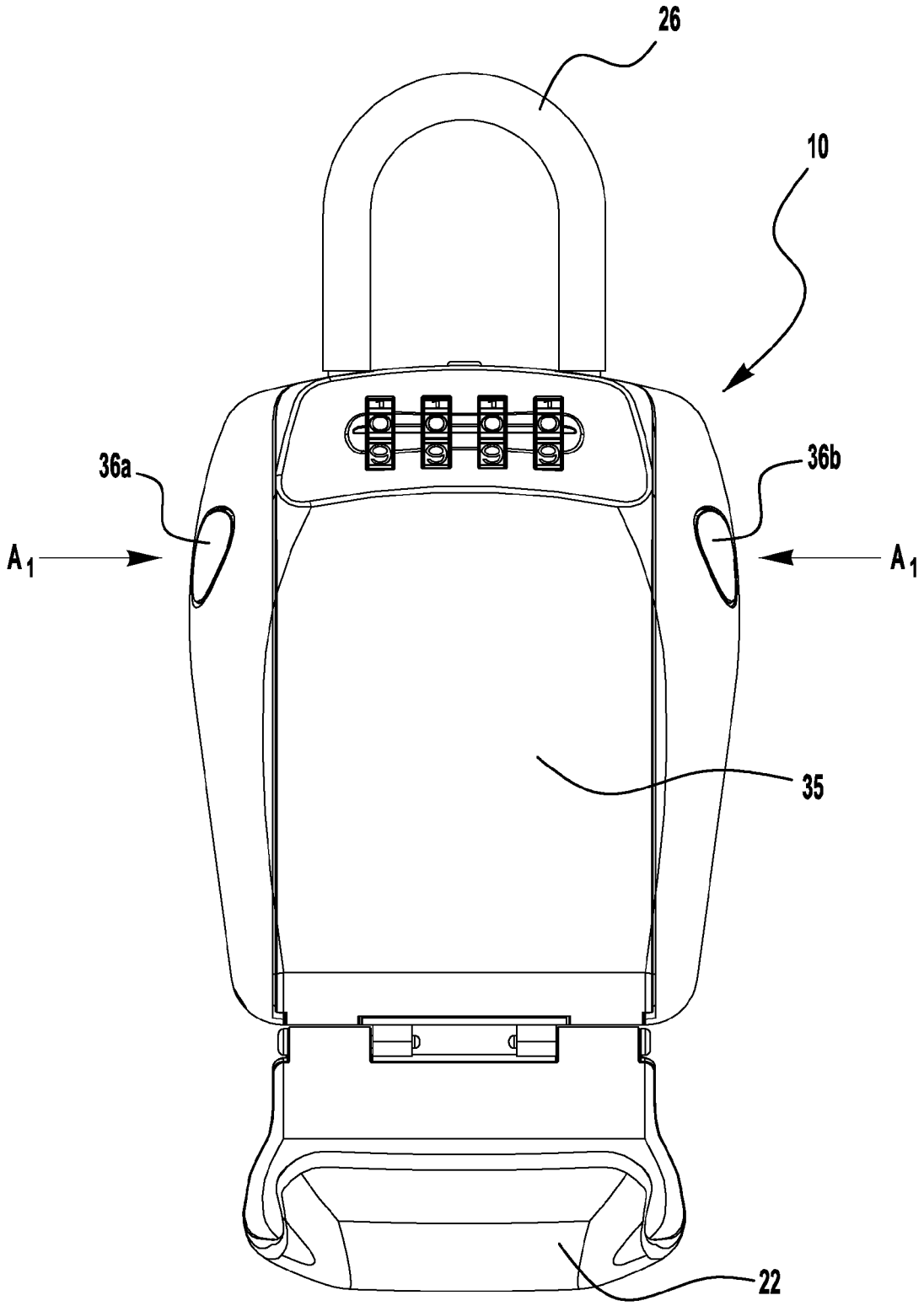
FIG. 3 is a front view of the safe of FIG. 1, shown with the cover fully opened and the combination dials exposed.

As discussed, with the cover 22 in an open position, a set of combination dials 28, 30, 32, 34 are exposed. A shackle 26 is positioned at the top of the safe 10. The shackle 26 can be utilized to secure the safe 10 to various locations, such as for example, through a wall-mounted hasp or around a door handle. The safe 10 includes opposing side buttons 36*a*, 36*b* on either side of the housing which may be compressed when the set of combination dials 28, 30, 32, 34 are turned by a user to a predetermined authorized combination. When the side buttons 36*a*, 36*b* are compressed inward in the direction $A_1$ shown in FIG. 3, a safe door 35 may be opened to provide user access to the internal compartment.

Figure 2A:
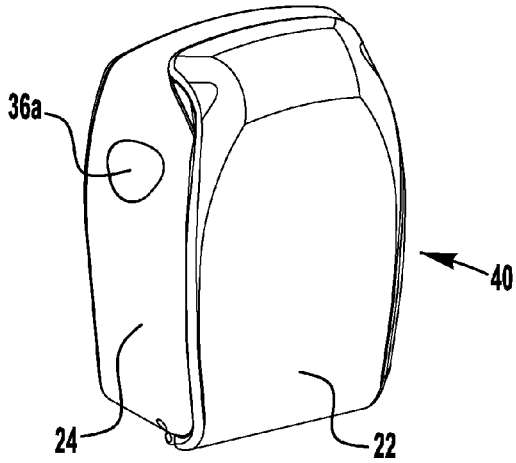
FIG. 2*a* is a front perspective view of another safe, showing a shackleless safe with a cover closed over a set of combination dials.
Figure 2B:
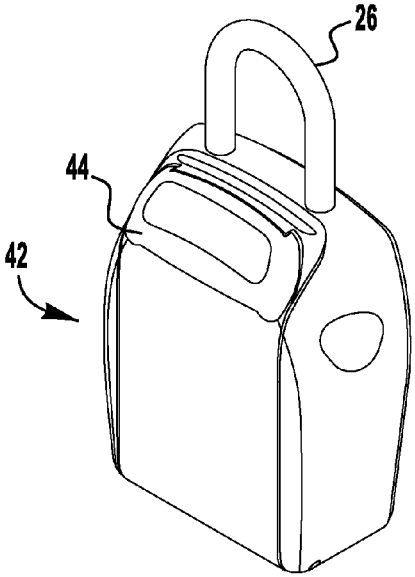
FIG. 2*b* is a front perspective view of yet another safe, showing a cover of relatively reduced length closed over a set of combination dials.

FIG. 2*a* is a front perspective view of another safe. A shackleless safe 40 can be wall-mounted, and is illustrated with the cover 22 closed. As such, the combination dials are not visible. The wall-mounted safe 40 is discussed later in greater detail. FIG. 2*b* is a front perspective view of another safe 42. A cover 44 is positioned over a set of combination dials (not shown). The cover 44 is relatively shorter in length, as compared to the cover 22 of the other illustrated safes 20, 40. An articulating arm (not shown) transitions the cover to a lower position along the body of the lock, leaving the dials exposed for user manipulation. It should be apparent to one with ordinary skill in the art that the present invention can be practice with a cover of any suitable length, without any cover, and with or without a shackle.

Figure 4B:
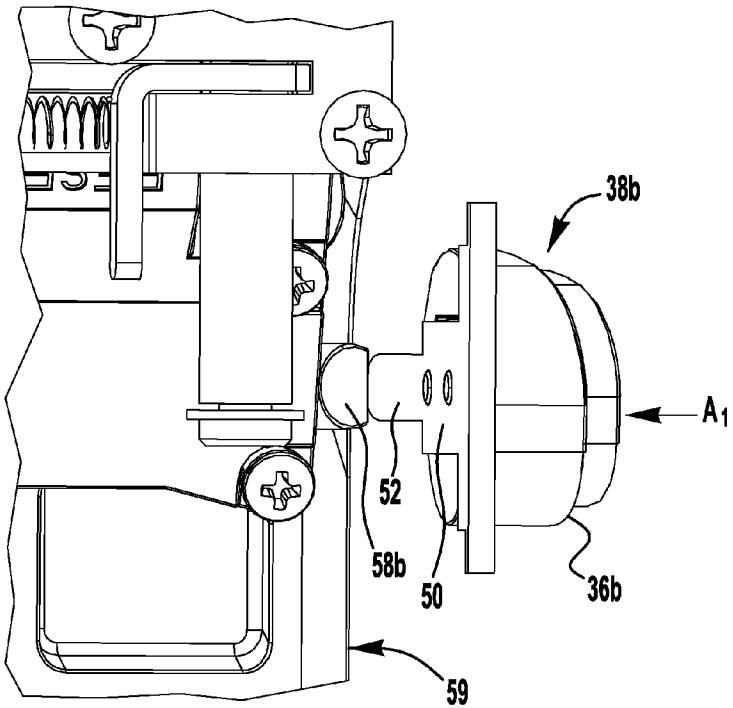
FIG. 4*b* is an enlarged view of a portion of FIG. 4*a;*
Figure 4A:
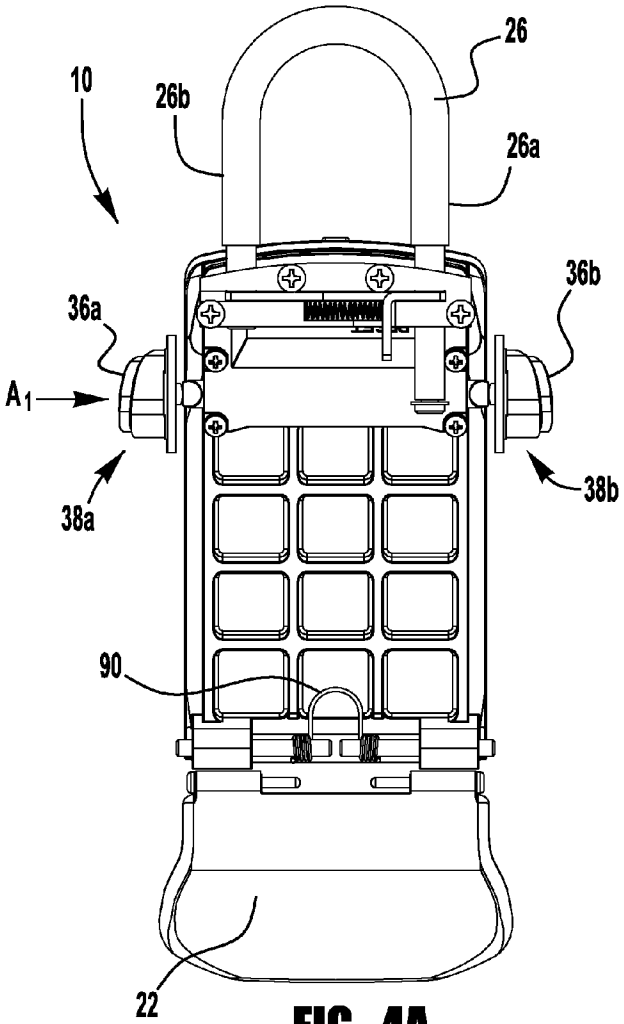
FIG. 4*a* is a rear view of the safe of FIG. 3, shown with portions of the safe removed to illustrate additional features of the safe.

A rear view of the safe 10 is shown in FIG. 4*a*. The cover 22 is open and the housing 24 and door 35 are not shown to illustrate additional features of the safe 10. FIG. 4*b* is an enlarged view of a portion of FIG. 4*a*, including a side button assembly 38*b* (see FIGS. 5*a* and 5*b*). In the illustrated embodiment of FIG. 4*a*, an essentially mirror image side button assembly 36*a* is positioned at the opposite side of the safe 10. As best seen in FIG. 4*b*, a side button 36*b* is engaged with a release tab 50. In the position shown in FIGS. 4*a* and 4*b*, the outer end 58*b* of the latch 60 blocks movement of the door from a closed position (see FIG. 3) to an open position (see FIG. 7). The outer edge may be tapered. When the set of combination dials are operated properly by an authorized user to a pre-determined combination, a user may engage the buttons 36*a*, 36*b* to open the door 35 and gain access to the contents of the internal compartment. By pushing in on the flush surfaces of the side buttons 36*a*, 38*b*, the tongue 52 of the release tab 50 is pressed inward against the outer end 58 of a latch 60 (shown in FIG. 6*a*).

Figure 5A:
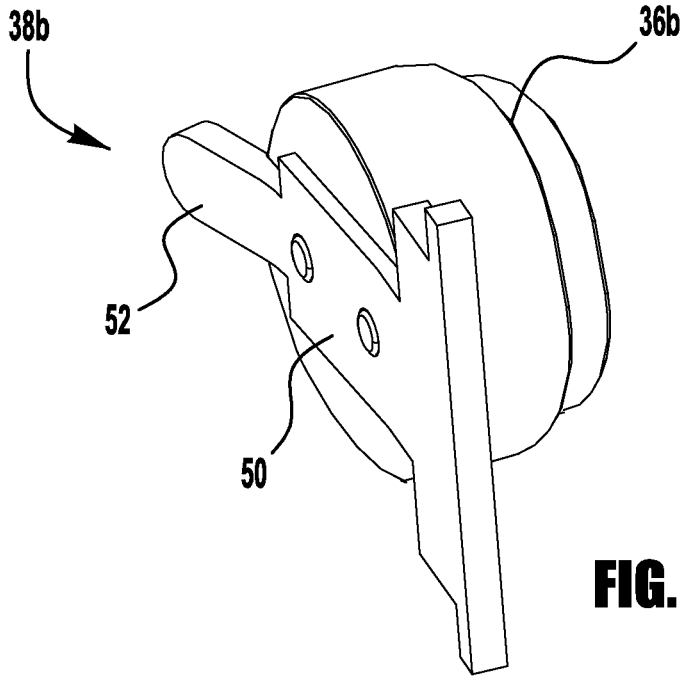
FIG. 5*a* is a rear perspective view of a side button assembly of the safe of FIG. 1, showing the side button engaged with a release tab.
Figure 5B:
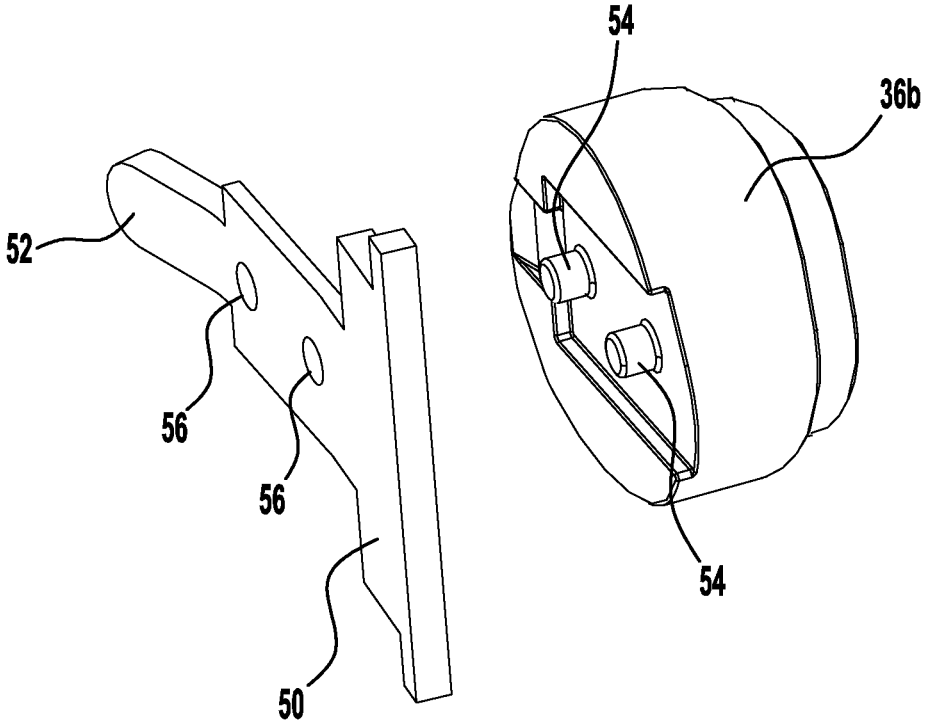
FIG. 5*b* is an exploded view of the side button assembly of FIG. 5*a;*

One or both sides of the inventive lock may include a side button assembly. As illustrated, lock 10 includes a side button assembly 38*a*, 38*b*. Regardless, the assembly of the side button and release tab are arranged to resist attack or other manipulation by an unauthorized user. The side buttons are flush with the outside surface of the housing to limit the effect of prying. The side buttons also include break away anti-tampering arrangements. FIG. 5*a* is a rear perspective view of the side button 36*a* shown engaged with a release tab 50. Two protrusions 54 are sized to engage apertures 56 on the release tab. Other engagement designs may be used. If an unauthorized user attempted to pry or otherwise attack the side button 36*b*, the engaged release tab 50 will break away from the button. Once the tab 50 is disengaged from the button, it is increasingly difficult for a user to drive the latch 60 with the tongue 52, and the release mechanism prohibits opening the safe.

Figure 6A:
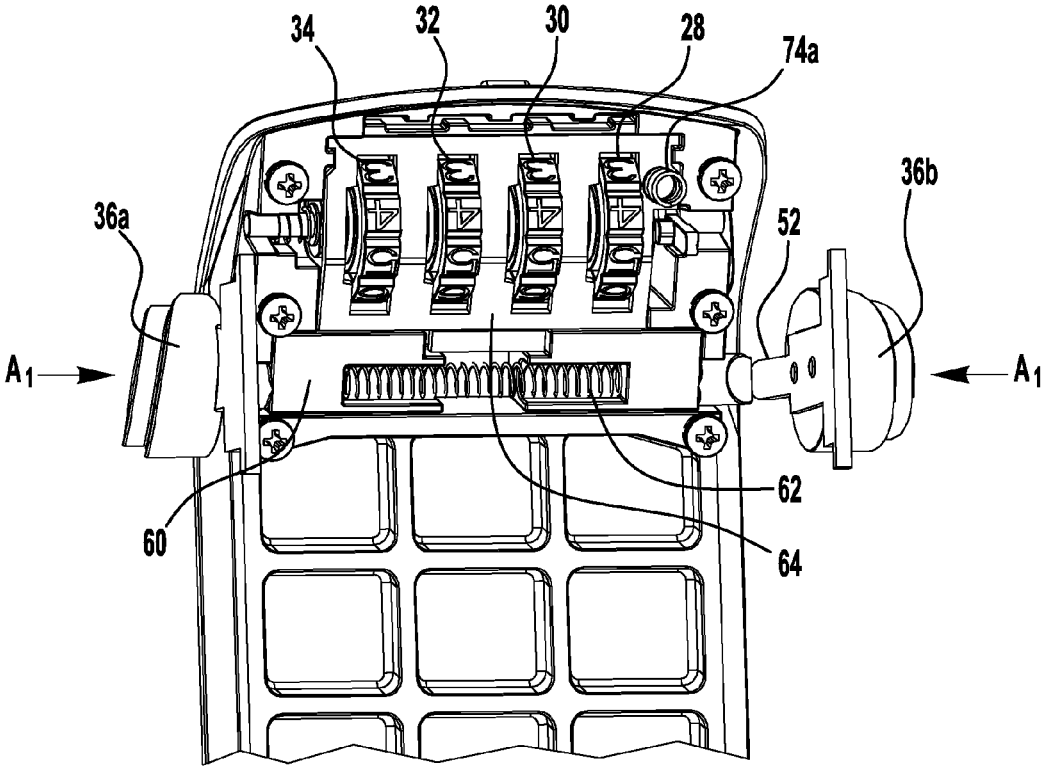
FIG. 6*a* is a rear perspective view of a portion of the safe of FIG. 1, shown with portions of the safe removed and illustrating a rear side of the set of combination dials.

As discussed, the exemplary safe has two mechanisms prohibiting unauthorized access to the safe contents. Prior to a user being able to properly manipulate the side buttons, a locking mechanism must be properly manipulated. FIG. 6*a* is a rear view of a portion of the safe 10 without the housing, door or cover shown. The rear side of the safe and combination dials 28, 30, 32, 34 are shown. The four combination dials extend through slots in the housing 24 to be accessible by the user. While the illustrated dials 28, 30, 32, 34 are shown to suggest ten increments labeled "0" through "9," the dials may be provided with a different number of increments and with different labeling, e.g., letters, symbols, or colors. Further, a different number of dials may be used.

Figure 6B:
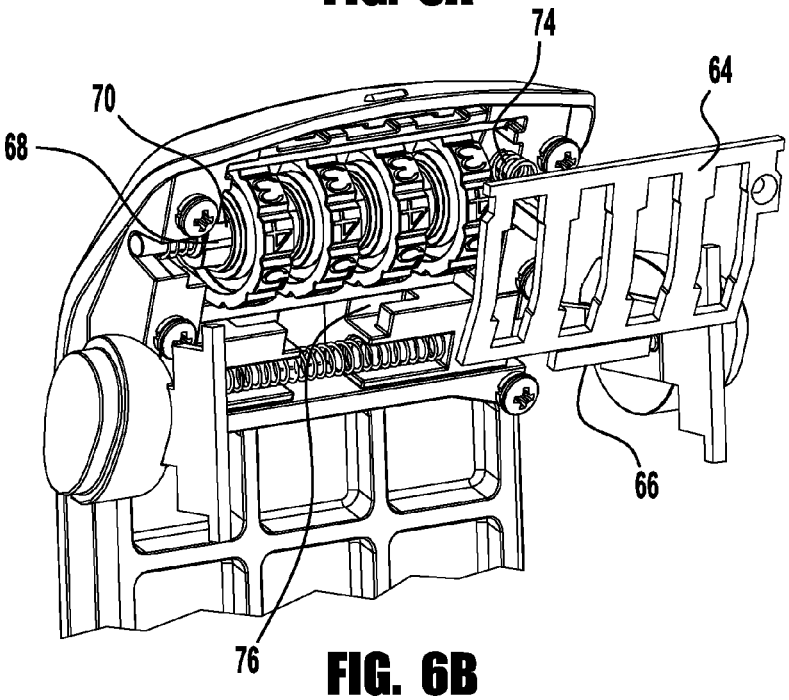
FIG. 6*b* is a partially exploded view of FIG. 6*a;*

As shown in FIGS. 6*a* and 6*b*, the dual locking structure of the safe 10 includes a second locking mechanism. The second mechanism may function as a release mechanism to allow opening of the door after the first locking mechanism has been properly manipulated. As shown, the releasing mechanism includes opposing latches 60 with integral springs 62. The opposing latches define two aligned slots 76. The releasing mechanism is disposed and arranged to interact with select features of the first locking mechanism, including a caged blocker 64 with a locking tab 66, and the four dial hubs 68 of the plurality of combination dials. Each hub defines a planar surface. With the door 35 in the closed position and locked condition, the tab 66 is position between the latches 60 and outside of the slots 76, as shown in FIG. 6*a*. In this position, the inward movement by the depression of the buttons 36*a*, 36*b* is prohibited by the tab 66.

When the four dials 28, 30, 32, 34 are rotated to a predetermined authorized combination, the dial hubs 68 with detents 70 line up axially in an arrangement to create a planar surface. Once the planar surface is created, the bottom portion of the caged blocker 64 is permitted to move inward by bias of a spring 74. In this position, the locking tab 66 of the caged blocker moves toward an outside of the safe 10 and into slots 76 defined by each latch 60. With the caged blocker 64 sufficiently moved to allow inward movement of the latches 60, the side buttons 36*a*, 36*b* can be compressed inward along the direction $A_1$ to drive the latches 60 with integral springs 62 open. As such, the outward edge 58 of each latch 60 clears the outer edge of the opening 59, moving the door 35 from the locked condition to the unlocked condition. With the latch removed, the door 34 is movable from the safe housing 24 to access an internal portion of the safe 10. For example, the door may spring open by force to the open position shown in FIG. 7. As visible by the door in the open position, the first and second locking mechanisms are mounted within the housing on the inside top surface of the door. An aperture 92 is shown in the housing internal side wall through which the latch outer edge 58*b* extends with the door in the closed position.

Figure 7:
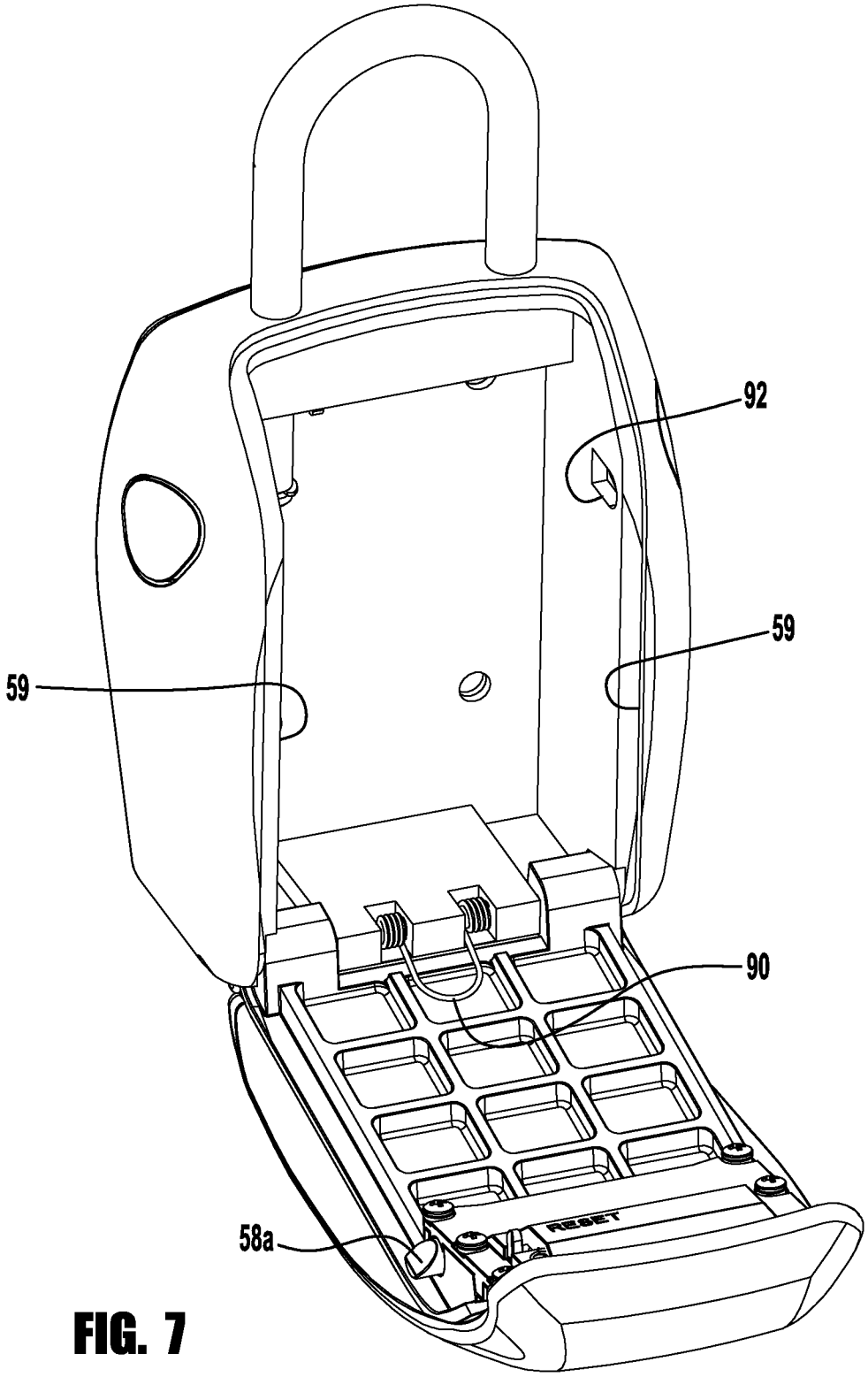
FIG. 7 is a front perspective view of the safe of FIG. 1, showing the cover and a door fully open to illustrate an internal cavity.

As discussed, the added security of the safe is enhanced by not having any external protrusions or extensions on the outside surface of the safe. To that end, the safe 20 includes a door 24 biased by a torsion spring 90, as shown in FIGS. 7 and 8*a*. The safe incorporates an integral spring that will allow the door to spring open when the buttons 36*a*, 36*b* are released. The spring 90 may be used in any embodiment and may vary in shape, location, and size.

Figure 8B:
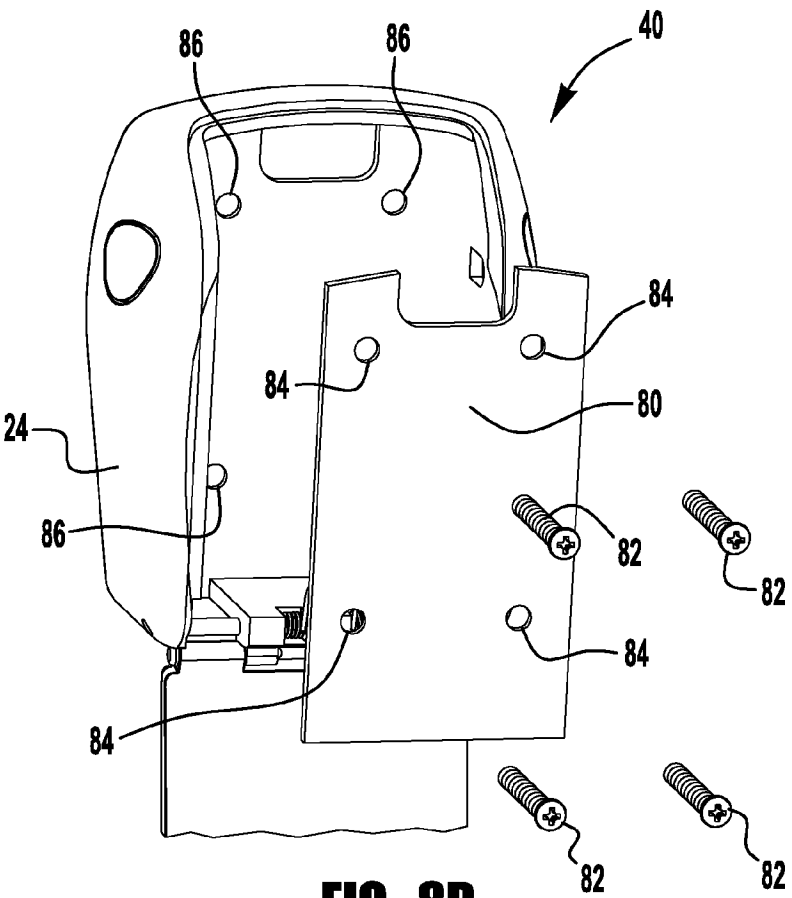
FIG. 8*b* is a partially exploded view of the safe of FIG. 8*a*.
Figure 8A:
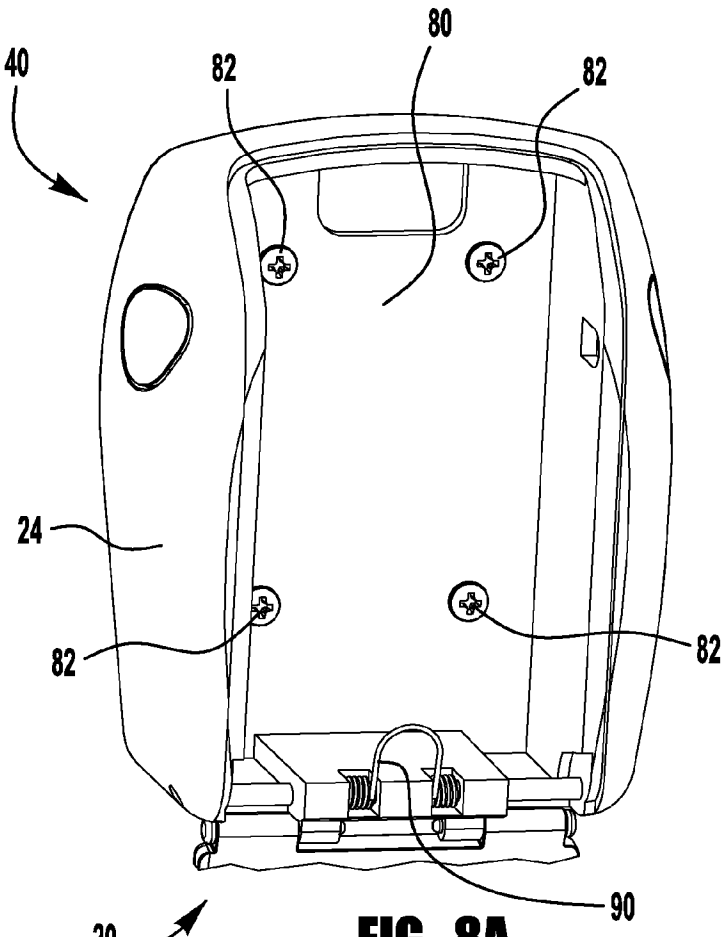
FIG. 8*a* is a rear perspective view of the safe of FIG. 2*a*, showing the cover and the door fully open to illustrate an internal cavity and an insert plate.

FIG. 8*b* is a partially exploded view of safe 20 of FIG. 8*a*. The wall-mounted safe 20 has an insert 80 to strengthen the mounting bolt interface. The insert may be from steel or any other suitable material. The insert 80 is placed in the inside the storage cavity. The mounting bolts 82 are then secured to the inside of the safe 20 through corresponding holes 84 in the insert and holes 86 in the housing. In the event the safe 20 is pried off the wall by an unauthorized user, the mounting bolt heads remain secured by the insert 80. This arrangement causes a higher strength assembly as the bolt heads are difficult to be pulled through the holes 84 in the insert 80.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A safe comprising:

a housing including opposed first and second side walls each having a wall thickness extending from an exterior surface to an interior surface defining an internal cavity therebetween in communication with an opening in the housing;

a door assembled to the housing, and movable between a closed position covering the opening and an open position to expose at least a portion of the opening;

first and second latches retained by the door and configured to lockingly engage corresponding first and second inner recesses in the interior surfaces of the corresponding first and second side walls of the housing in the locked condition when the door is in the closed position;

a locking member retained by the door and configured to block disengagement of the first and second latches from the first and second side walls when the locking member is in a locked condition, and to permit disengagement of the first and second latches from the first and second side walls when the locking member is in an unlocked condition;

a user operable lock interface at least partially disposed on an external surface of the door and operable to move the locking member from the locked condition to the unlocked condition; and first and second side buttons disposed at least partially within the corresponding first and second inner recesses of the first and second side walls of the housing, each side button being operable to disengage the corresponding latch from the corresponding inner recess to permit movement of the door from the closed position to the open position when the locking member is in the unlocked condition, wherein each side button is disconnected from the corresponding latch at least when the door is in the open position.

2. The safe of claim 1, wherein the user operable lock interface comprises a plurality of combination dials mounted about a post, each of the plurality of combination dials defining a planar detent, wherein each detent aligns when the locking member is in the unlocked condition.

3. The safe of claim 2, wherein the locking member comprises a blocker that is held in a latch blocking condition by at least one of the plurality of combination dials when the locking member is in the locked condition.

4. The safe of claim 1, wherein the first and second side buttons are co-axially arranged.

5. The safe of claim 1 further comprising a door opening mechanism comprises a spring loaded member configured to move the door from the closed position to the open position upon user operation of the first and second side buttons.

6. The safe of claim 1, wherein the first and second side buttons each include an outer surface that is substantially flush with an outer surface of a corresponding one of the first and second side walls.

7. The safe of claim 1, wherein the first and second side buttons each include a projection that extends from a user engageable button body through an opening in a corresponding one of the first and second side walls to engage the corresponding latch.

8. The safe of claim 7, wherein the projections of the first and second side buttons are detachably connected to the corresponding button bodies, such that an effort to pry one of the first and second buttons away from the corresponding side wall causes the corresponding button body to detach from the corresponding projection such that the opening in the corresponding side wall remains blocked.

9. A lock comprising:

a housing;

a locking mechanism at least partially disposed within the housing, the locking mechanism comprising:

at least one locking member movable between a locked condition and an unlocked condition;

at least one latch having an outer edge that is secured in a corresponding lock recess when the at least one locking member is in the locked condition; and a user operable lock interface operable to move the at least one locking member from the locked condition to the unlocked condition; and at least one button extending through a fixed outer wall of the housing and into the corresponding lock recess, the at least one button being depressible in a first direction to press against the outer edge of the corresponding latch to slide the outer edge of the corresponding latch in the first direction out of engagement with the corresponding lock recess when the at least one locking member is in the unlocked condition;

wherein the at least one locking member comprises first and second locking members extending toward corresponding opposed first and second side wall portions of the fixed outer wall of the housing, and the at least one button comprises first and second side buttons extending through the corresponding first and second side wall portions.

10. The lock of claim 9, wherein the lock recess is disposed in an inner surface of the fixed outer wall.

11. The lock of claim 9, further comprising a door assembled with the housing and movable from a closed position blocking access to an interior of the housing to an open position when the at least one locking member is in the unlocked condition.

12. The lock of claim 11, wherein the locking mechanism is retained by the door.

* * * * *